US006660939B1

(12) United States Patent
Gunnels

(10) Patent No.: US 6,660,939 B1
(45) **Date of Patent: *Dec. 9, 2003**

(54) METHOD AND APPARATUS FOR SHIELD SLOT SIGNAL COUPLER

(75) Inventor: Robert Gunnels, Lockport, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/065,948

(22) Filed: Dec. 3, 2002

Related U.S. Application Data

(63) Continuation-in-part of application No. 10/064,946, filed on Aug. 30, 2002.

(51) Int. Cl.[7] ..... H01R 7/12

(52) U.S. Cl. ..... 174/75 C; 174/102 SP; 174/88 C

(58) Field of Search ..... 174/71 C, 75 C, 174/88 R, 88 C, 78, 102 SP; 333/245

(56) References Cited

U.S. PATENT DOCUMENTS

| | | | | | |
|---|---|---|---|---|---|
| 1,675,163 | A | | 6/1928 | Colburn | |
| 3,141,060 | A | * | 7/1964 | Norton | 174/73.1 |
| 3,602,872 | A | | 8/1971 | Braunstein | |
| 4,365,859 | A | | 12/1982 | Hutter | |
| 4,464,583 | A | * | 8/1984 | Holmgren | 307/147 |
| 4,738,009 | A | | 4/1988 | Down | |
| 4,795,356 | A | | 1/1989 | Pauza | |
| 5,281,933 | A | | 1/1994 | Chamberlin | |
| 5,382,932 | A | * | 1/1995 | Monti | 333/245 |
| 6,312,281 | B1 | | 11/2001 | Rodriguez | |
| 6,362,709 | B1 | | 3/2002 | Paxman | |
| 6,392,504 | B1 | | 5/2002 | Stein | |
| 6,417,456 | B1 | * | 7/2002 | Leijon et al. | 174/120 SC |

* cited by examiner

*Primary Examiner*—Chau N. Nguyen
(74) *Attorney, Agent, or Firm*—Babcock IP, LLC

(57) ABSTRACT

A method and apparatus for forming a cable coupler for coupling a co-axial trunk cable having a trunk outer conductor, to a coupler cable. A channel is formed in the trunk outer conductor; a first coupler conductor is coupled to a first side of the channel; and a second coupler conductor is coupled to a second side of the channel. Alternatively, a trough may be formed and a conductor coupled with one end of a conductor inserted in the trough. Channels or troughs may be pre-formed in a trunk cable creating coupler connection points that may be quickly adapted to form a coupler with minimal field installation requirements. The coupler coupling factor may be varied by electrically shortening the channel or trough with, for example, a conductive ring, conductive foil or a conductive collar.

23 Claims, 7 Drawing Sheets

METHOD AND APPARATUS FOR SHIELD SLOT SIGNAL COUPLER

CROSS REFERENCE TO RELATED APPLICATIONS

This application is a continuation-in-part of U.S. utility patent application No. 10/064,946, titled "Shield Slot Tap", filed Aug. 30, 2002, assigned to Andrew Corporation.

BACKGROUND OF INVENTION

1. Field of the Invention

The invention relates to electrical cable couplers, also known as cable taps. More specifically, the invention relates to a cable coupler with low insertion losses and a variable coupling factor.

2. Description of Related Art

Many systems, for example in-building RF distribution systems or antenna arrays, utilize a trunk cable from which multiple connections, couplers, are made. For example, a trunk cable extending between several floors of a building may be coupled to supply/receive a signal to/from each floor. Each coupler applied to the trunk cable draws off a specified portion of the signal power present at the coupler location on the trunk cable. Therefore, successive couplers with a common coupling factor attached to the same trunk cable will receive a progressively lower signal level at each coupler location.

"Piggy back" cable couplers permit the diversion of a signal from a trunk cable to a second cable and vice versa, without requiring the attachment of connectors to the trunk cable. Conventional "piggy back" co-axial cable couplers introduce a contact pin through an aperture created in the trunk cable's shield/outer conductor that contacts the trunk cable's center conductor. Creation of the aperture, without damaging the center conductor, is time consuming and normally requires a dedicated tool.

The contact pin of a conventional co-axial cable coupler creates a significant impedance discontinuity with mismatch loss. The mismatch loss, of a for example 10 dB coupler, combined with radiation and coupled energy losses, may create an insertion loss of up to approximately 1.5 dB with respect to the trunk cable, depending on the coupler, trunk cable type and the operating frequency. Where energy conservation is desired, or multiple couplers are required, the insertion loss from a conventional center conductor contacting co-axial cable coupler may be significant.

Couplers with low insertion losses exist. However, these devices require cutting the trunk cable at a desired insertion point, installing connectors at both sides of the break and insertion of the coupler, in-line. The separate structure of the coupler, required connectors and time-consuming installation procedure may cause this type of coupler to be undesirably expensive.

Competition within the coupler connector market has also focused attention on minimization of materials and manufacturing costs.

Therefore, it is an object of the invention to provide a method, apparatus and a kit for a coupler(s) which overcome deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

U.S. utility patent application No. 10/064,946, filed Aug. 30, 2002 is hereby incorporated by reference in the entirety.

RF energy in a co-axial cable, propagates in the space between a center conductor and a surrounding outer conductor. The formation of a, for example, generally u-shaped slot/discontinuity (channel) in the trunk cable outer conductor/shield, having an open end and a closed end aligned parallel to the cable center longitudinal axis and an inside and an outside shield area with respect to the channel, interrupts an RF current path between either shield area. The interrupted RF current path around the channel induces a voltage potential between either side of the closed end of the u-shaped channel. Therefore, by connecting a second, for example, co-axial cable across the channel, a cable coupler may be formed which couples RF energy but does not require contact with the center conductor of the trunk cable. Because the creation of a significant impedance discontinuity is avoided, reflective losses and therefore overall insertion loss due to the addition of the cable coupler to the trunk cable is minimized.

Figure 1:
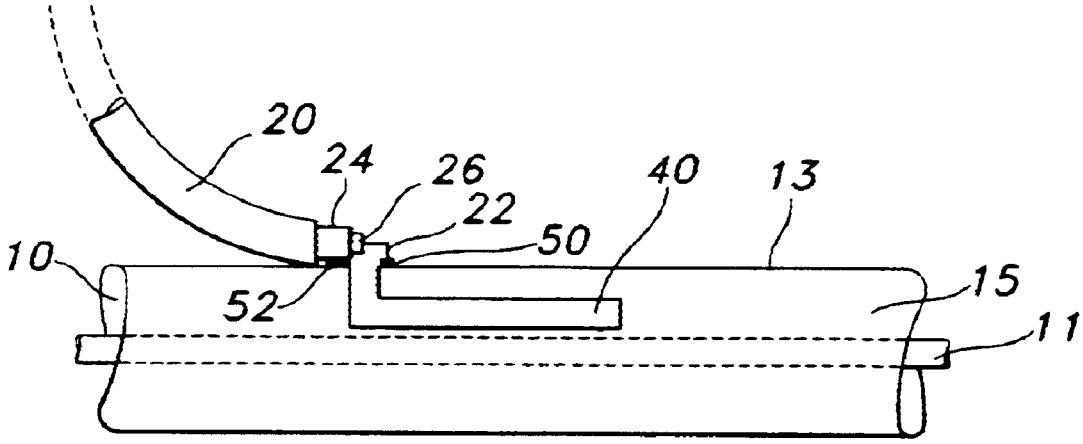
FIG. 1 shows a cut-away side view of a first embodiment of the invention.
Figure 2:
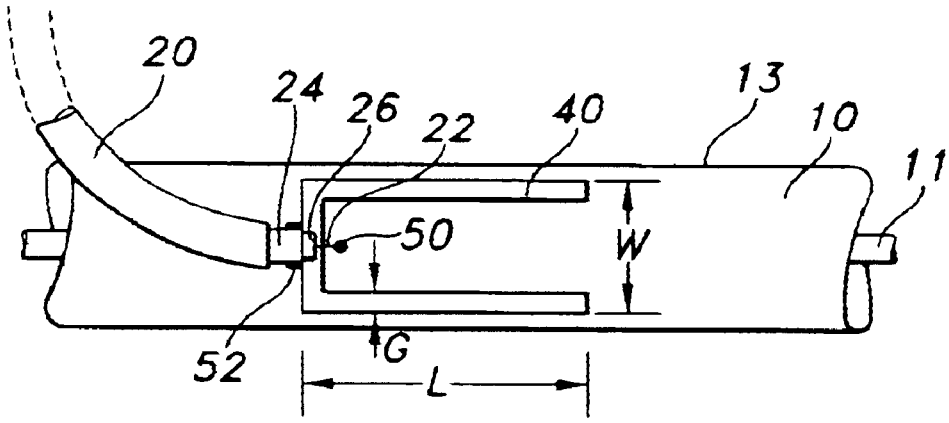
FIG. 2 shows an external top view of the first embodiment of the invention.

In a first embodiment, as shown in FIGS. 1 and 2, a co-axial trunk cable 10 has a trunk center conductor 11 spaced away from a trunk outer conductor 13 by a trunk dielectric 15. A, for example co-axial, coupler cable 20 has a coupler center conductor 22 spaced away from a coupler outer conductor 24 by a coupler dielectric 26. The trunk dielectric 15 and or coupler dielectric 26 may be any material with suitable dielectric properties, including air. Further, the coupler cable 20 may be any form of conductor, including for example micro strip conductors or a single conductor acting as a radiating element.

A channel 40 is formed through the trunk outer conductor 13 having a length L and a width W. The channel 40 may have a U-shape, open ended rectangular shape, V-shape or other form having an open end defined by the overall axial length L parallel to a center longitudinal axis of trunk cable 10 and a transverse width W or arc length around the trunk outer conductor 13. An open end of the channel 40 may be aligned facing either a RF generator or RF load end of trunk cable 10. A gap width G of the channel 40 may vary along the channel 40 but is at least large enough to create an electrical continuity break in the trunk outer conductor 13. Length L is greater than or equal to gap width G.

The coupler center conductor 22 may be coupled with the trunk outer conductor 13 at an inside coupling point 50 proximate to the closed end of the channel 40. The coupler outer conductor 24 may be coupled with an outside coupling point 52 of the closed end of the channel 40. Alternatively, the connection points of the coupler center conductor 22 and coupler outer conductor 24 may be reversed, i.e. coupled with coupling points 52 and 50, respectively.

Locations of the inside and outside coupling points 50,52 are not critical other than their locations being on either side of the channel 40 at points where an RF voltage differential exists. Dimensions L, W and G of the channel 40 and the location of connection points 50,52, determine a coupling level that is described herein below.

The coupling of the coupler center conductor 22 and coupler outer conductor 24 with the trunk outer conductor 13 may be, for example, via soldering, spring clip(s), direct mechanical connection or mechanical compression via elongated straps or mechanical clamp(s). Any manner of securing electrical connection may be used; with care taken that the manner selected does not provide a short circuit across the channel 40.

Figure 3:
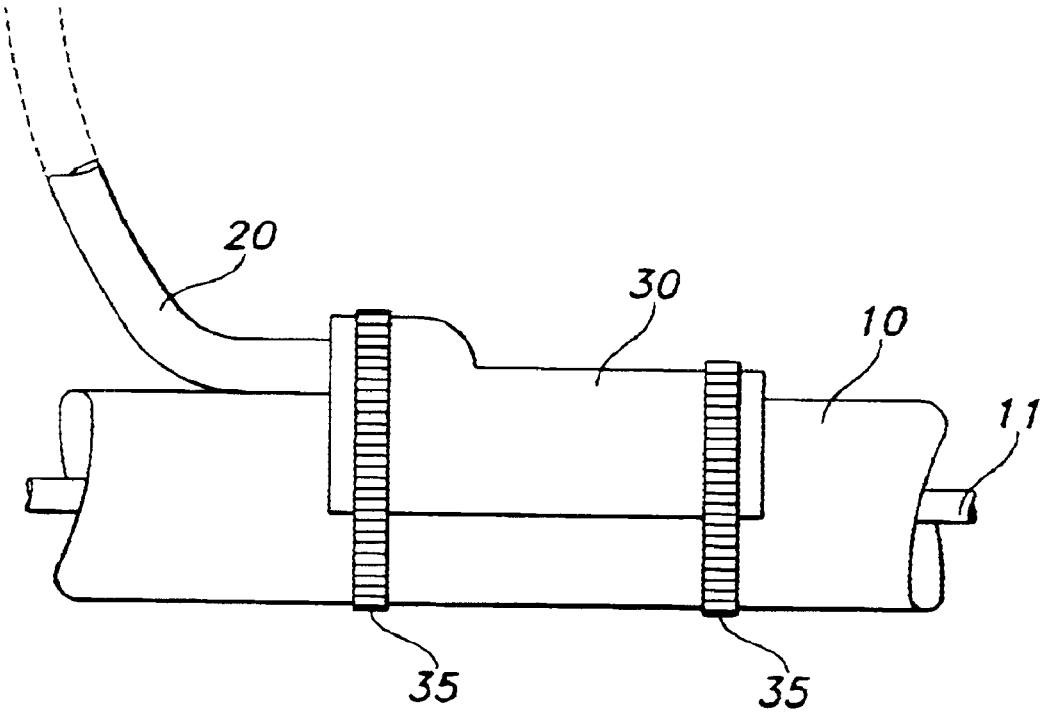
FIG. 3 shows an external side view of one embodiment of a cover usable with the invention.

As shown in FIG. 3, a cover 30 held in place, for example, by elongated straps 35, adhesive or mechanical clamps may be used to protect the coupler from environmental contaminants and/or maintain the electrical coupling of the coupler cable 20 with the trunk cable 10. The cover 30 may also include, insulated so as not to form a short circuit across the channel 40, an RF shield 33 to minimize RF energy radiation losses/interference from the trunk cable 10 through the channel 40 and from the exposed portion of the coupler center conductor 22.

Figure 4:
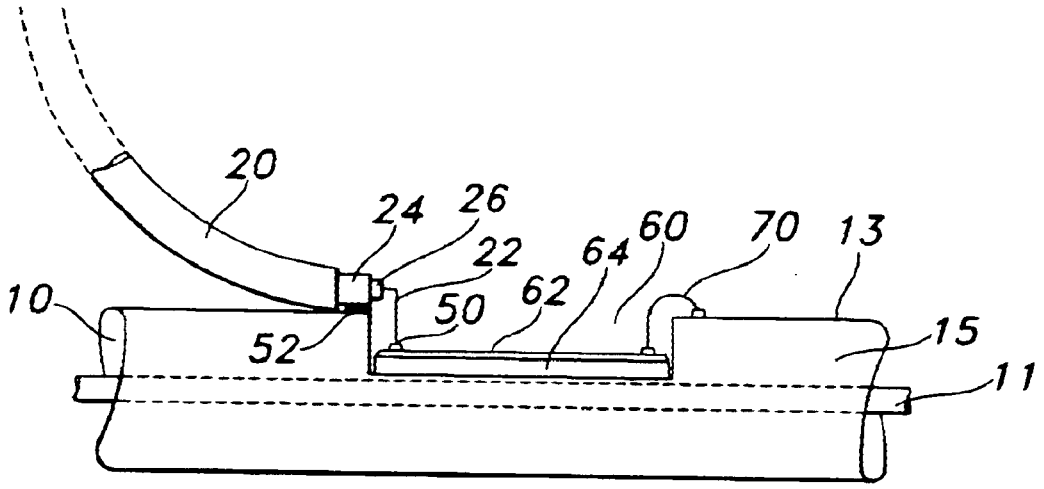
FIG. 4 shows a cut-away side view of a second embodiment of the invention.
Figure 5:
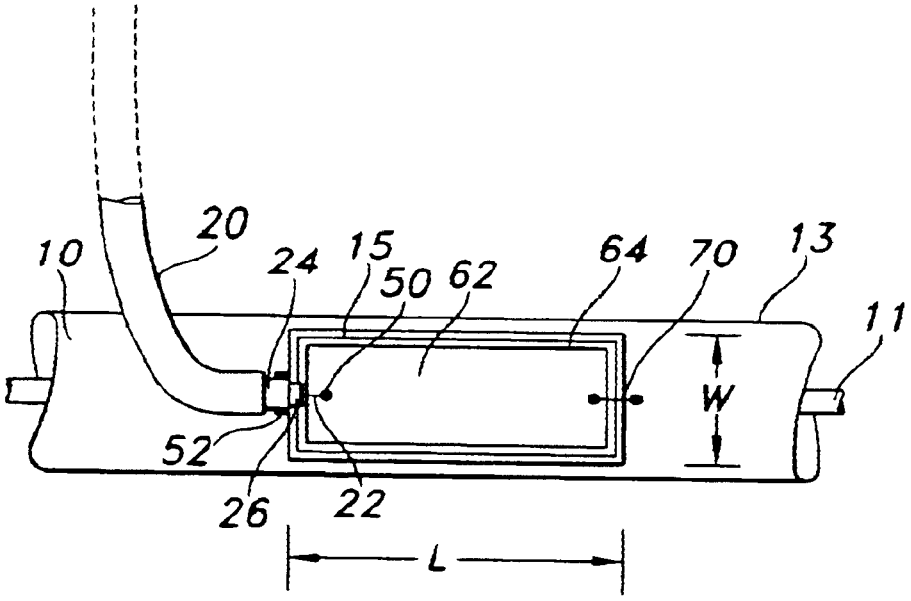
FIG. 5 shows an external top view of the second embodiment of the invention.
Figure 6:
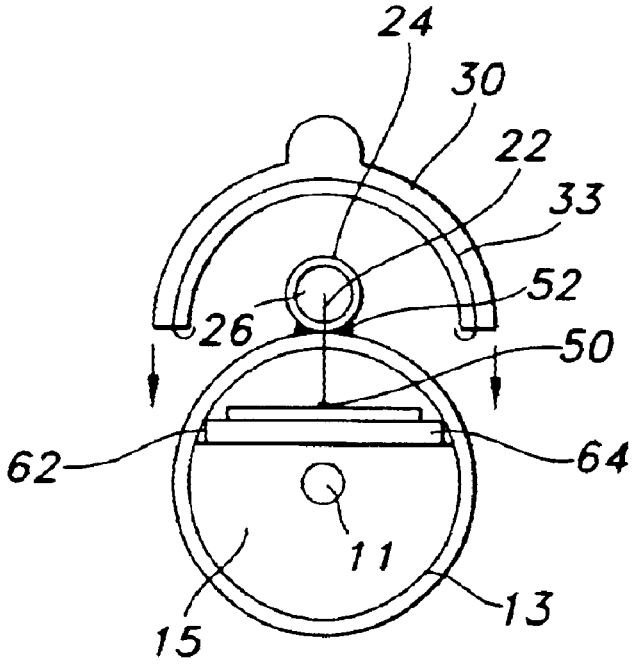
FIG. 6 shows a cross-section view of the second embodiment of the invention.

As shown in FIGS. 4, 5 and 6, a second embodiment may use an aperture or trough 60 formed in the trunk outer conductor 13. The trough 60 may be of any shape, generally having an overall length L and a width W. A conductor 62 is placed in the trough 60 with one end, along the trunk cable center longitudinal axis, in electrical contact with the trunk outer conductor 13 via a conductor/shield coupling 70 but otherwise electrically isolated from the trunk outer conductor 13, thereby creating an electrical equivalent of the channel 40 structure of the first embodiment. Conductor/shield coupling 70 may be, for example, via soldering, spring clip(s), direct mechanical connection or mechanical connection via elongated straps or mechanical clamp(s). Further, the conductor/shield coupling 70 may be omitted. The positioning of conductor 62 may, for example, be aided by the use of adhesive, elongated strap(s) or mechanical connection, for example to the trunk dielectric 1 5 or trunk center conductor 11. Alternatively, the conductor 62 may be mounted to the cover 30, which is then secured to the trunk cable 10 as previously described.

The coupler cable 20 is connected similarly to the first embodiment, with connections, for example, of the coupler center conductor 22 to the trunk outer conductor 13 at an inside coupling point 50 of the closed end of the conductor 62 and a connection of the coupler outer conductor 24 with an outside coupling point 52 of the closed end of the channel formed between the conductor 62 and the trunk outer conductor 13.

To ensure that the conductor 62 is isolated from the trunk outer conductor 13, the conductor 62 may be formed as a conductive layer spaced away from the edges of all but the back end of an insulating substrate 64, for example a printed circuit board (PCB). The portion of conductor 62 extending to a back end of the insulating substrate 64 may then become the conductor/shield coupling 70 coupled with the trunk outer conductor 13. If no conductor/shield coupling 70 is desired, or if a jumper or other connection for conductor/shield coupling 70 is used, the conductor 62 may be spaced away from all edges of the insulating substrate 64.

Figure 7:
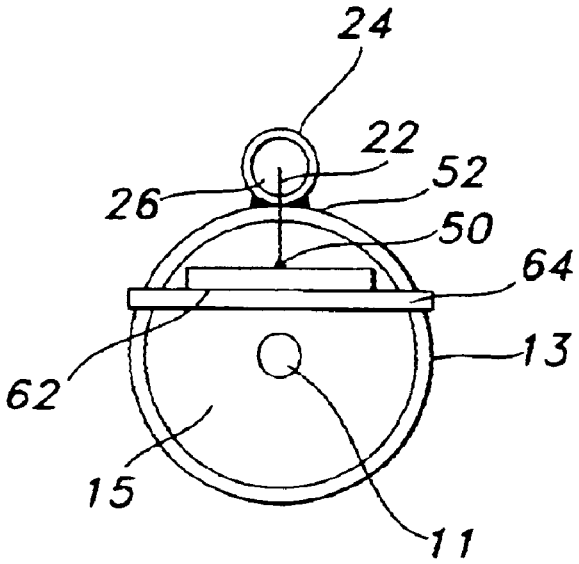
FIG. 7 shows a cross-section view of a third embodiment of the invention.

In a third embodiment as shown in FIG. 7, for example, where the trunk cable 10 has an air dielectric 15, the insulating substrate 64 may be dimensioned to fit against the edges of the trunk outer conductor 13 defining the trough 60 and or against the trunk center conductor 11, thereby maintaining a fixed location of the conductor 62, even where there is no dielectric material to support the insulating substrate 64.

Both the second and third embodiments may have a cover 30 as shown, for example, in FIGS. 3 and 6, discussed herein above.

The channel 40 or trough 60 may be formed by cutting or otherwise removing at least trunk outer conductor 13 material and dielectric 15, if applicable, with a scroll saw, band saw, router, grinder, laser or other channel/trough forming device. Specific dimensions of the channel 40 or trough 60 may be formed using guides that may be made for specific trunk cable dimensions and types.

To form the, for example, open ended rectangular channel 40 using a scroll saw a first cross-sectional cut may be made in the trunk outer conductor 13 to a desired depth creating the W dimension. When the bottom of the first cut is reached, the angle of cutting is changed to be parallel to a center longitudinal axis of the trunk cable 10 for a length L of a longitudinal cut. The movement may then be reversed, allowing removal of the cutting element.

When using a cutting method that cuts across the cable, through the dielectric 15, the depth of the first cross-sectional cut should be shallow enough so that the trunk center conductor 11 is not contacted. Manipulation of the cutting angle across the trunk outer conductor 13 or use of a router or other controlled depth cutting method removes this requirement.

Alternatively, a trough 60 may be formed in the trunk cable 10 by making a single, for example with a grinding tool, or series of cross-sectional cut(s), removing trunk outer conductor 13 and if applicable trunk dielectric 15 from a desired length and width of the trunk cable 10.

The selected overall length L, width W and channel width G dimensions of the channel 40 or trough 60 determine a coupling factor of the cable coupler. The coupling factor is a measure of how much of the total RF energy present in the trunk cable 10 is coupled to the coupler cable 20, the remainder continuing along the trunk cable 10. Generally, increases in length L and width W increases coupling.

Figure 8:
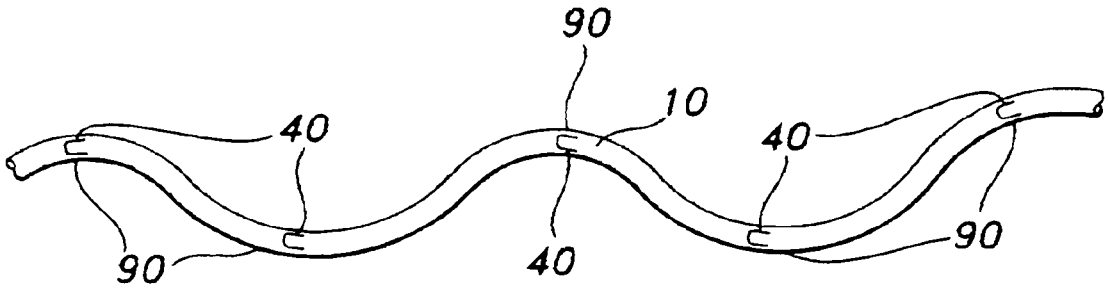
FIG. 8 shows an external top view of a conductor embodiment of the invention.
Figure 9:
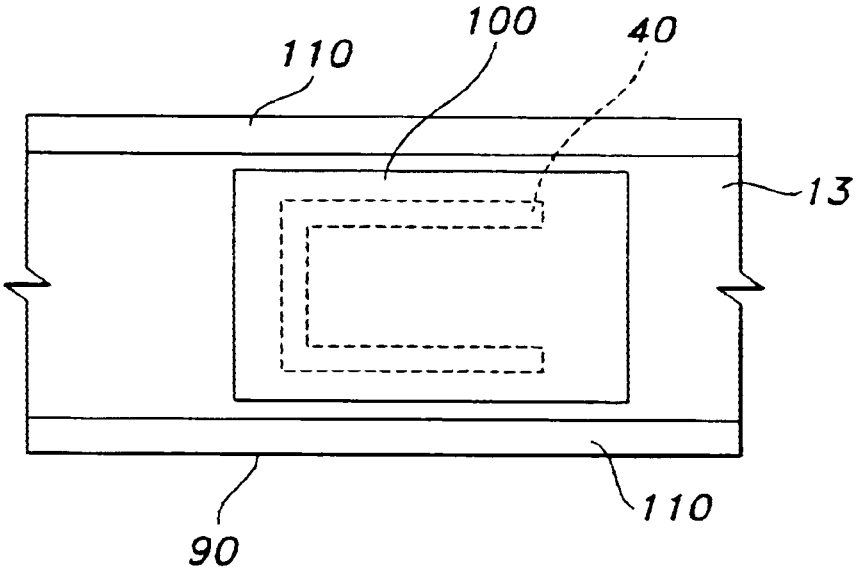
FIG. 9 shows a cut-away view of the conductor embodiment of the invention.

The channel 40 or trough 60 may also be formed in the trunk cable 10 prior to trunk cable 10 installation and or at the time of trunk cable 10 manufacture. In a controlled environment, high precision channel(s) 40 and or trough(s) 60 may be efficiently formed using dedicated computer controlled machine tooling that may be, for example, too bulky, complex and or expensive to use onsite and or upon an installed trunk cable 10. As shown in FIG. 8, a plurality of channels 40 or troughs 60 may be pre-formed at desired coupler connection points 90 along the trunk cable 10.

Where the locations of coupler connection points 90 and or the number of couplers to be installed are unknown, a trunk cable 10 may be pre-formed with coupler connection points 90 spaced at regular intervals. To reduce trunk cable 10 conductor corrosion, electrical characteristic degradation, RF leakage and or environmental contamination due to unused coupler connection points, the coupler connection points 90 may be covered after forming the channel 40 or trough 60 with, for example, a conductive foil 100 that may be secured to the trunk outer conductor 13 by, for example, an adhesive and or sealed under a trunk cable outer coating 110 of, for example, polyethylene as shown in FIG. 9. Markings along the outer coating may be used to aid users with location of the coupler connection points. Alternatively, the unused coupler connection points 90 may be covered with a conductive foil 100 or. other sealing/shielding after installation is complete.

To utilize a pre-formed coupler connection point 90, the outer coating 10 covering the desired coupler connection point, if present, may be removed along with any conductive foil 100. Connection of a coupler cable 20 may then be completed as described herein above.

Because the coupler connection points 90 may be pre-formed using precision equipment, each successive coupler connection point 90 may be specifically dimensioned for a desired coupling factor to create an array or network of. couplers on the trunk cable 10 that has a common coupler cable 20 signal strength. For example, coupler connection points 90 farther along the trunk cable 10 from a signal generator may be configured to have a higher coupling factor to make up for signal strength coupled by the previous couplers and or lost to cable/conductor attenuation.

Figure 10A:
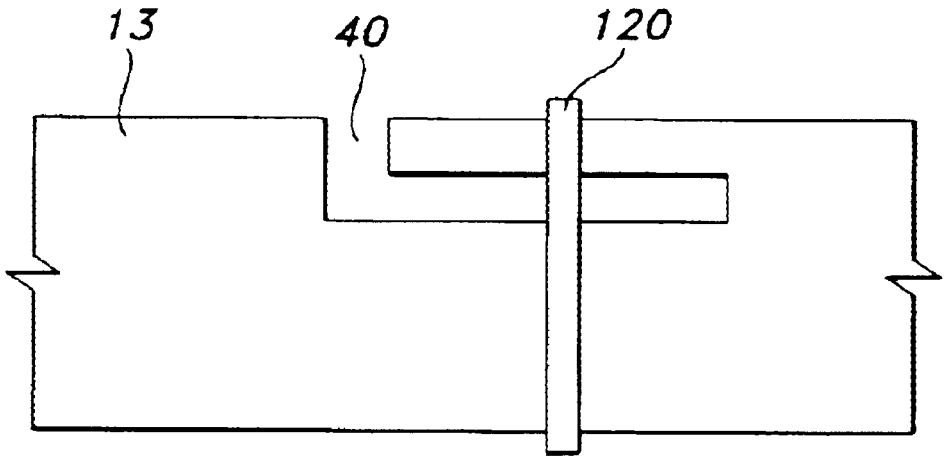
FIG. 10*a* shows a cut-away side view of a variable coupling factor embodiment of the invention.
Figure 10B:
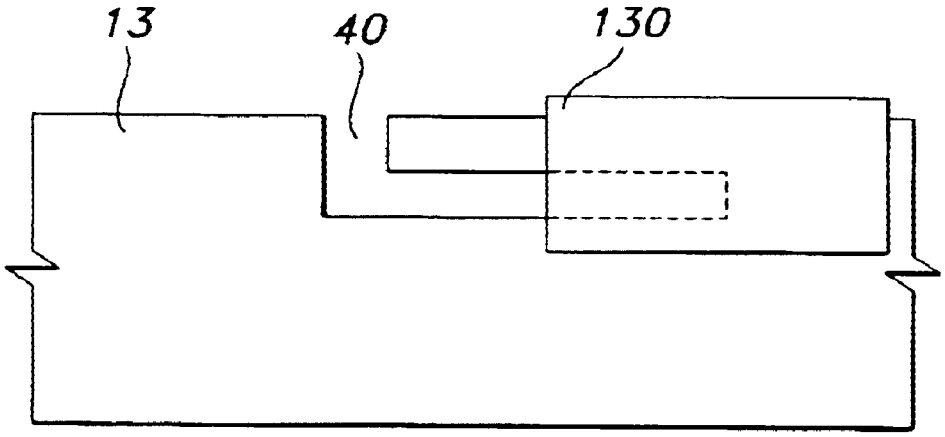
FIG. 10*b* shows a cut-away side view of another variable coupling factor embodiment of the invention.

Single or multiple coupler connection points 90 may also be formed configured with a larger coupling factor than desired upon installation. As shown in FIGS. 10*a* and 10*b a,* for example, conductive clip, collar, ring 120 and or conductive tuning foil 130 may then be used to electrically shorten the dimensions of the channel 40 or trough 60 thereby adjusting the individual coupler to a desired coupling factor. In this way, a desired common coupler cable 20 signal strength may be quickly obtained even if the number and or spacing of the installed couplers and any other signal loss sources are unknown prior to trunk cable 10 field installation.

Figure 11A:
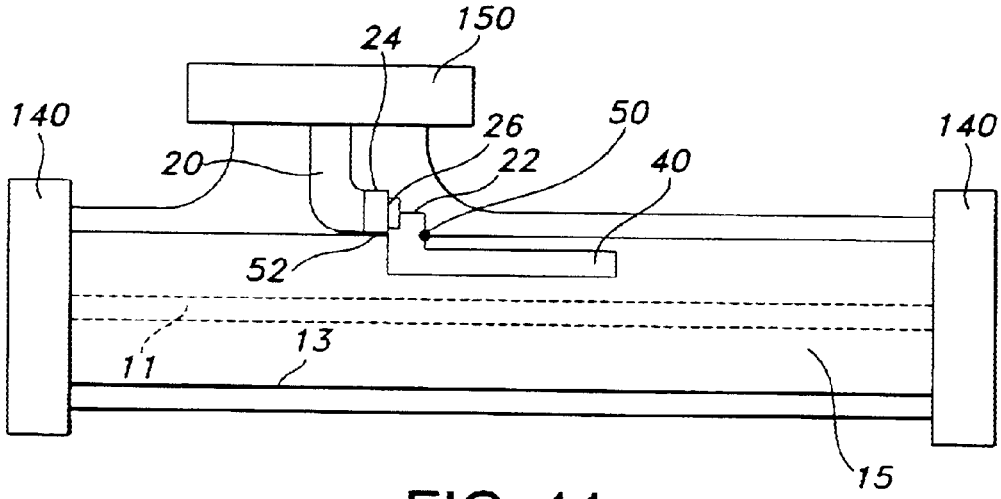
FIG. 11*a* shows an external and partial cut-away view of an in-line embodiment of the invention.
Figure 11B:
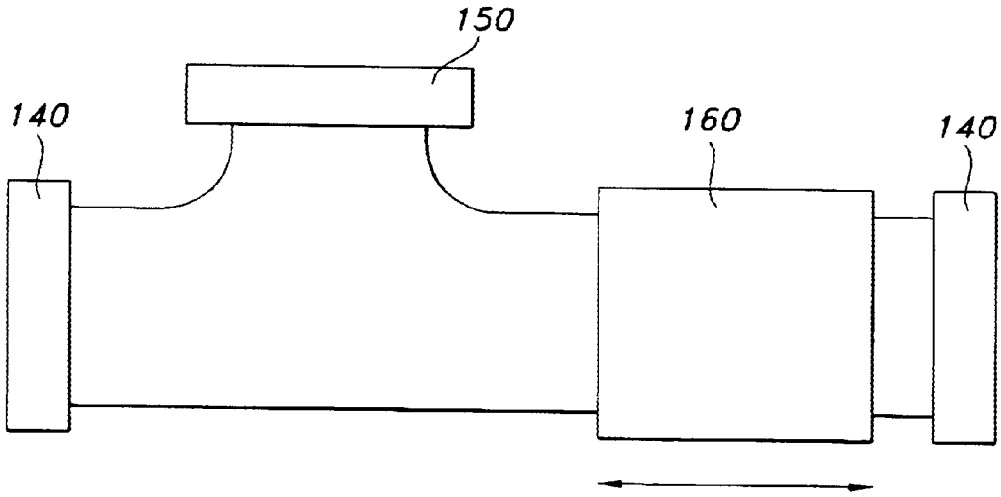
FIG. 11*b* shows an external view of an in-line variable coupling factor embodiment of the invention.

In an in-line embodiment, as shown in FIG. 11*a,* the coupler may be formed as a separate component with trunk connectors 140 for insertion, in-line with a trunk cable 10 and a coupler connector 150 for connection to the coupler cable 20. As shown in FIG. 11*b,* the in-line embodiment may be given high precision variable coupling factor capability through the addition of a, for example, conductive collar 160 movable to electrically shorten the channel 40 or trough 60 length and or width dimensions as applicable. The conductive collar 160 may be movable, for example, via rotation about threads or axially along notches, a ridge or groove.

As described, the shield slot coupler provides the following advantages. The shield slot coupler has a reduced insertion loss and may be inexpensively formed without any external elements beyond the trunk cable 10 and the coupler cable 20, thereby decreasing component costs. The coupler may be formed with an adjustable coupling factor. Trunk cables may be manufactured with regularly spaced channels 40 and or troughs 60 that can be quickly and inexpensively utilized as couplers as desired.

Table of Parts

| | |
|---|---|
| 10 | trunk cable |
| 11 | trunk center conductor |
| 13 | trunk outer conductor |
| 15 | dielectric |
| 20 | coupler cable |
| 22 | coupler center conductor |
| 24 | coupler outer conductor |
| 26 | coupler dielectric |
| 30 | cover |
| 33 | RF shield |
| 35 | elongated strap |
| 40 | channel |
| 50 | inside coupling point |
| 52 | outside coupling point |
| 60 | trough |
| 62 | conductor |
| 64 | insulator substrate |
| 70 | conductor/shield coupling |
| 90 | coupler connection point |
| 100 | conductive foil |
| 110 | trunk cable outer coating |
| 120 | ring |
| 130 | conductive tuning foil |
| 140 | trunk connector |
| 150 | coupler connector |
| 160 | conductive collar |

where in the foregoing description reference has been made to ratios, integers or components having known equivalents then such equivalents are herein incorporated as if individually set forth.

while the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A coaxial cable having a plurality of coupler connection points, each of the coupler connection points comprising:

a channel formed in an outer conductor of the coaxial cable, between a first connection point and a second connection point; the channel forming an electrical discontinuity that is less than a complete break in the outer conductor; and the channel has one of an open ended rectangular shape, a U-shape and a V-shape.

2. The cable of claim 1, wherein the channel is covered by a conductive foil.

3. The cable of claim 2, wherein the conductive foil surrounds the outer conductor.

4. The cable of claim 2, wherein the conductive foil is proximate each of the channels.

5. The cable of claim 1, wherein the channel is formed by removing an area of the outer conductor and inserting a conductive element spaced away from at least a portion of an edge of the outer conductor surrounding the area.

6. The cable of claim 1, wherein the cable has an outer coating.

7. The cable of claim 6, wherein the outer coating is polyethylene.

8. The cable of claim 6, wherein a visual marking is located on the outer coating; the visual marking identifying the location of each of the coupler connection points.

9. A coaxial cable having a plurality of coupler connection points, each of the coupler connection points comprising:

a channel formed in an outer conductor of the coaxial cable, between a first connection point and a second connection point; the channel forming an electrical discontinuity that is less than a complete break in the outer conductor; the channel is arranged with an open end aligned with the longitudinal axis of the cable.

10. A coaxial cable having a plurality of coupler connection points, each of the coupler connection points comprising:

a channel formed in an outer conductor of the coaxial cable, between a first connection point and a second connection point; the channels configured to generate a coupling factor calculated to create a substantially common signal level in a tap cable connected at each of the connection points.

11. A coaxial cable having a plurality of coupler connection points, each of the coupler connection points comprising:

a channel formed in an outer conductor of the coaxial cable, between a first connection point and a second connection point; a coupling factor of each connection point is equal to or greater than a coupling factor for each successive connection point from a first end of the cable to a second end of the cable.

12. A signal coupler for coupling a signal from a co-axial trunk cable, to a coupler cable, comprising:

a first trunk connector, coupling a trunk outer conductor and a trunk center conductor to a second trunk connector, and a coupler connector, coupling a tap outer conductor to a first side of a channel formed in the trunk outer conductor and a tap inner conductor to a second side of the channel; the channel forming an electrical discontinuity in the trunk outer conductor that is less than a complete break in the trunk outer conductor.

13. The coupler of claim 12, wherein the channel forms an electrical break between the first and second sides of the channel.

14. The coupler of claim 12, wherein an RF current path between the first conductor and the second conductor, along the trunk outer conductor is interupted by the channel.

15. The coupler of claim 12, wherein the channel has one of an open ended rectangular shape, a U-shape and a V-shape.

16. The coupler of claim 15, wherein the channel is arranged with an open end aligned with the longitudinal axis of the trunk cable.

17. The coupler of claim 12, wherein the channel is formed by removing an area of the outer conductor and inserting a conductive element spaced away from at least a portion of an edge of the outer conductor surrounding the area.

18. A coaxial cable signal coupler, comprising:

an electrical discontinuity, a first connection point, and a second connection point, the first connection point and the second connection point located on opposing sides of the electrical discontinuity in an outer conductor of the coaxial cable; the electrical discontinuity forming less than a complete break in the outer conductor, and a tap cable center conductor is coupled with the outer conductor at the first connection point and a tap outer conductor is coupled with the outer conductor at the second connection point.

19. The coupler of claim 18, wherein the dimensions of the electrical discontinuity are adjustable.

20. A method for coupling a first cable to a second cable, comprising the steps of:

coupling a first conductor of the second cable and a second conductor of the second cable to opposite sides of an electrical discontinuity in an outer conductor of the first cable; the electrical discontinuity forming less than a complete break in the outer conductor.

21. The method of claim 20, wherein the first conductor and the second conductor are located along a longitudinal axis of the first cable.

22. The method of claim 20, further including the step of adjusting a dimension of the electrical discontinuity to create a desired coupling factor.

23. A method for manufacture of a signal coupler between a coaxial cable and a tap cable, comprising the steps of:

forming an electrical discontinuity in an outer conductor of the coaxial cable between a first tap cable connection point and a second tap cable connection point; the electrical discontinuity forming less than a complete break in the outer conductor;

coupling a tap cable center conductor with the outer conductor at the first tap cable connection point;and coupling a tap outer conductor with the outer conductor at the second tap connection point.

* * * * *